US005950377A

United States Patent [19]

Yoder

[11] Patent Number: 5,950,377

[45] Date of Patent: Sep. 14, 1999

[54] DECK STRUCTURE

[75] Inventor: Dennis G. Yoder, Nappannee, Ind.

[73] Assignee: Royal Crown Limited, Milford, Ind.

[21] Appl. No.: 08/694,768

[22] Filed: Aug. 9, 1996

[51] Int. Cl.[6] ..... E04F 11/16

[52] U.S. Cl. ..... 52/177; 52/263; 52/588.1

[58] Field of Search ..... 52/177, 263, 179, 52/180, 181, 588.1, 489.1, 474, 506.08, 506.09; 405/218, 219, 220; 114/366, 267

[56] References Cited

U.S. PATENT DOCUMENTS

| | | | |
|---|---|---|---|
| 1,441,327 | 1/1923 | Blum . | |
| 1,900,319 | 3/1933 | Vermeulen . | |
| 1,923,544 | 8/1933 | Leonard et al. . | |
| 3,464,067 | 9/1969 | Hauck . | |
| 3,587,503 | 6/1971 | Stehr . | |
| 3,620,027 | 11/1971 | Nordell . | |
| 3,691,974 | 9/1972 | Seiford, Sr. et al. . | |
| 3,959,830 | 6/1976 | van den Broek . | |
| 3,964,221 | 6/1976 | Berquist . | |
| 3,999,397 | 12/1976 | Albery . | |
| 4,078,515 | 3/1978 | Svirklys . | |
| 4,087,948 | 5/1978 | Mellor . | |
| 4,266,381 | 5/1981 | Deller . | |
| 4,349,297 | 9/1982 | Misener . | |
| 4,352,597 | 10/1982 | Kay . | |
| 4,840,824 | 6/1989 | Davis . | |
| 4,892,052 | 1/1990 | Zook et al. . | |
| 5,009,045 | 4/1991 | Yoder . | |
| 5,027,503 | 7/1991 | Sawdon . | |
| 5,048,448 | 9/1991 | Yoder . | |
| 5,054,253 | 10/1991 | Bedics | 52/177 X |
| 5,617,689 | 4/1997 | Beang | 52/177 X |
| 5,647,184 | 7/1997 | Davis | 52/177 X |

OTHER PUBLICATIONS

*Bulletin No. 60,* "Clinching", BTM Coporation.

*Primary Examiner*—Creighton Smith
*Attorney, Agent, or Firm*—Barnes & Thornburg

[57] ABSTRACT

A deck structure adapted for assembly with a supporting frame. The deck structure includes a plurality of clip members adapted to be secured to the supporting frame and a plurality of planks adapted to be assembled with the clip members. The clip members having an elongated base portion and plank receiving portions attached to said base portion for engaging and securely retaining the planks in engagement with the clip members. Each elongated base portion of the clip members having a first and a second end, the first end of the elongated base portions being adapted to be engaged with the second end of the elongated base portions of another clip member.

28 Claims, 3 Drawing Sheets

34
52
22
36
54
56
82
86
18
24
16
22b
62
6
30
7
22a
29
32
72

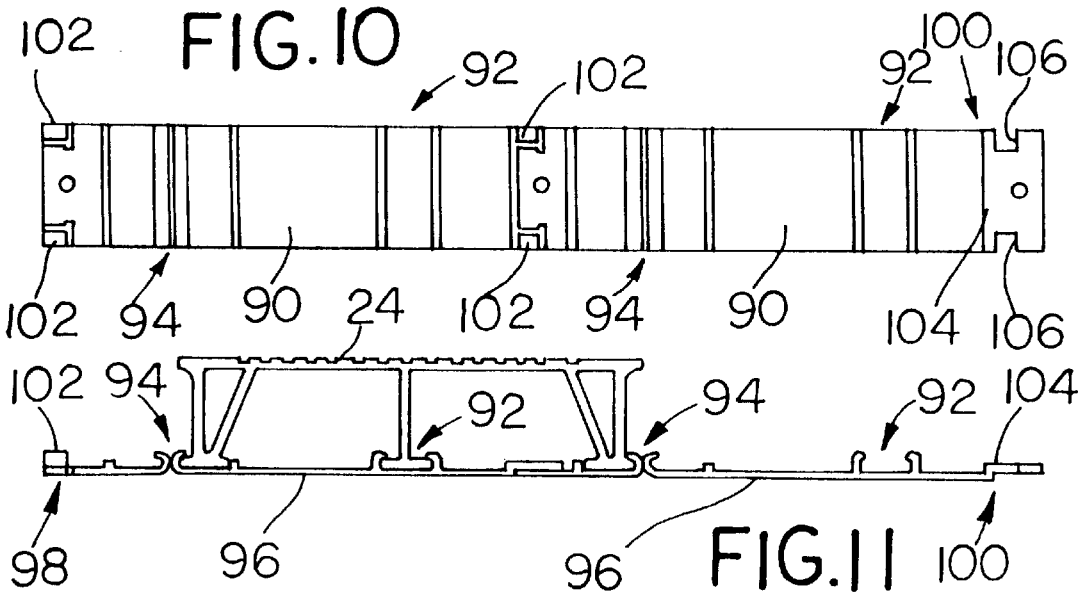
FIG.10
FIG.11
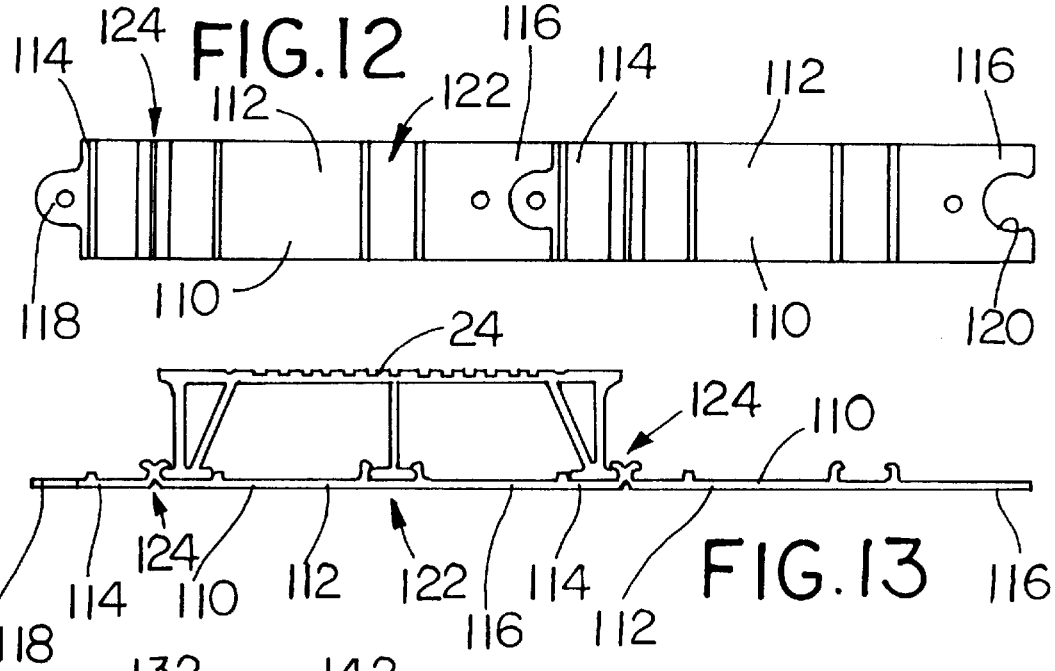
FIG.12
FIG.13
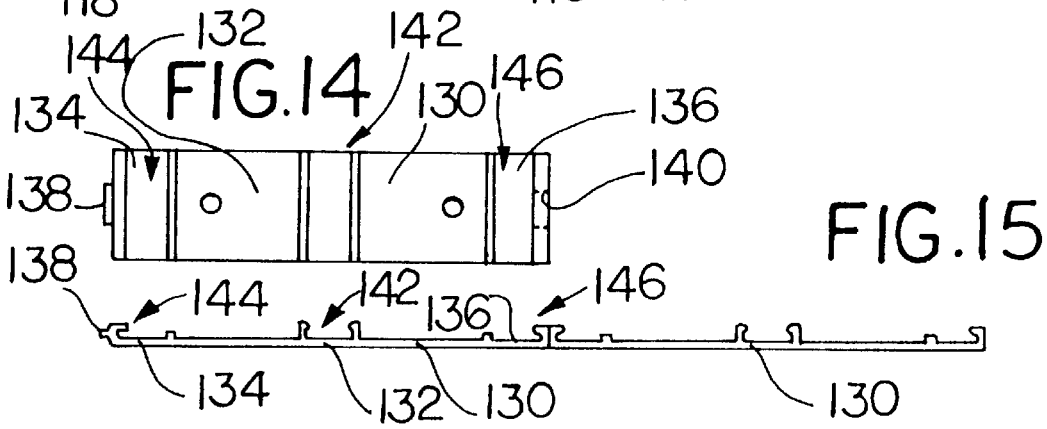
FIG.14
FIG.15

DECK STRUCTURE

BACKGROUND OF THE INVENTION

1. Field of the Invention

This invention relates generally to deck structures and more particularly to deck structures adapted for mounting to a frame or the like.

2. Description of Background Art

Deck structures are commonly used in residential, commercial and marine environments. In the residential setting, decks provide an outdoor setting for social and family entertainment. In the marine environment, deck structures are used for providing boat docks. As used herein, "deck structure" is intended to include residential, commercial and marine deck structures including docks.

Decks are generally constructed of pilings which are secured in the ground and stringers are secured to these pilings creating a support frame to which planks are appropriately attached. While wood and metal planking have been accepted as decking materials, mainly because of a lack of alternatives, there are many problems associated with these decking materials and the fasteners used to secure them to the frame. Wood planking tends to warp, splinter, and rot; problems which are inherit in wood and accelerated in a harsh outdoor environment. Likewise, exterior metal planking, most commonly aluminum, used in dock structures tend to corrode in the humid marine environment and often become uncomfortably hot in direct sun.

Further, both of these materials are difficult to reliably attach to the underlying support structure. For example, the nails, screws, or other fasteners used to hold the planking down tend to loosen over a period of the use and protrude through the top surface of the planking creating a potential hazard. Also, once fasteners become loose, the planks become unstable and may even become detached.

Accordingly, it is desirable to provide deck structures which utilize plastic materials. An exemplary plastic dock structure is disclosed in U.S. Pat. No. 5,048,448 which is assigned to the assignee of the present invention. In that patent, a dock structure is disclosed which includes plastic plank members which are secured to plastic clip members. The plastic clip members are each formed with an intermediate plank receiving means and side plank receiving means at each end thereof. Each of the clip members must be individually attached to the support structure and each plank is individually attached to an individual clip member.

Accordingly, it is desirable to provide a clip member which is long enough to support several planks. However, while it is possible to extrude long clip members from plastic, it has been found that the interconnection between a plastic clip member and a plastic plank can squeak. In addition, while the use of a plastic plank member with an aluminum clip member eliminates that squeak, the process for extruding very wide aluminum members is extremely difficult.

SUMMARY OF THE INVENTION

It is desirable in the art of deck structures to provide long clip members which are capable of supporting several planks.

It is also desirable in the art of deck structures to provide a design for clip members which enables the clip members to be securely fastened to one another in order to provide integrated longer clip members.

It is generally desirable to provide a deck structure adapted to be mounted to a frame or the like and which resists deterioration in the outdoor environment.

It is further desirable to provide a deck structure which is weather resistant, durable, and aesthetically pleasing.

It is also desirable to provide a deck structure that is easy to assemble and is securely retained in its assembled state.

Accordingly, the present invention provides a deck structure adapted for assembly with a supporting frame, said deck structure comprising a plurality of clip members adapted to be secured to said supporting frame and a plurality of planks adapted to be assembled with said clip member, said clip members having any elongated base portion and plank receiving portions attached to said base portion for engaging and securely retaining said planks in engagement with said clip members, each elongated base portion of said clip members having a first and a second end, said first end of said elongated base portions being adapted to be engaged with said second end of said elongated base portions of another clip member. Preferably, the clip members are formed from aluminum and the plurality of planks are formed of a plastic material.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only and thus are not limitative of the present invention, and wherein:

FIG. 10 is a plan view of a pair of clip members which are fastened to one another according to a second embodiment of the present invention;

FIG. 11 is a side view of the clip members shown in FIG. 10 having a plank fastened thereto;

FIG. 12 is a plan view of a pair of clip members fastened to each other according to a third embodiment of the present invention;

FIG. 13 is a side view of the clip members shown in FIG. 12, and having a plank fastened thereto;

FIG. 14 is a plan view of a clip member according to a fourth embodiment of the present invention; and FIG. 15 is a side view illustrating how the clip members of FIG. 14 are locked together in engagement.

DETAILED DESCRIPTION OF THE PREFERRED EMBODIMENTS

Figure 1:
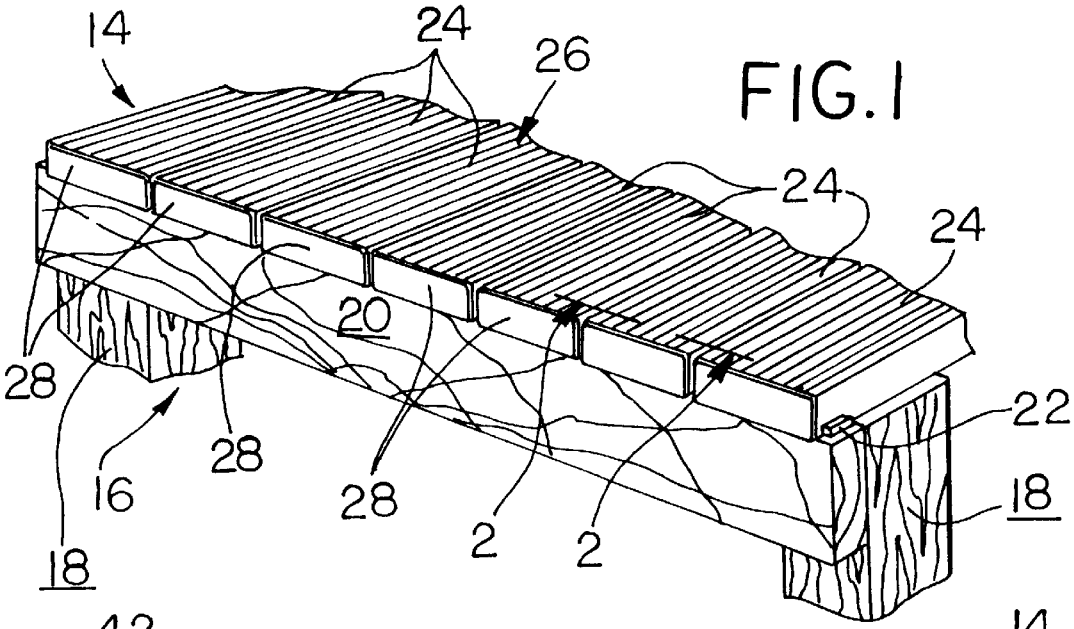
FIG. 1 is partial perspective view of an assembled deck structure comprising plank members attached to clips which are fastened to an underlying support structure in accordance with the principles of the present invention.

The present invention relates generally to the deck accessory, arts, and more particularly to deck structures adapted for mounting to a frame or the like. As illustrated in the partial perspective view of FIG. 1, an assembled deck structure 14 is attached to a support structure or frame 16. The frame 16 comprises pilings with posts 18 driven into the earth below with stringers 20 running therebetween to support the deck structure 14 between the posts 18. A plurality of clip members 22 illustrated in FIG. 2, are interengaged to one another in order to form an elongated plank support strip which is attached to the frame 16 for engaging and securely retaining plank members 24 in order to form the top plane or surface 26 of the deck structure 14. Each plank member 24 having an open end which may be covered with a plank cap 28 for providing a finished appearance.

Figure 2:
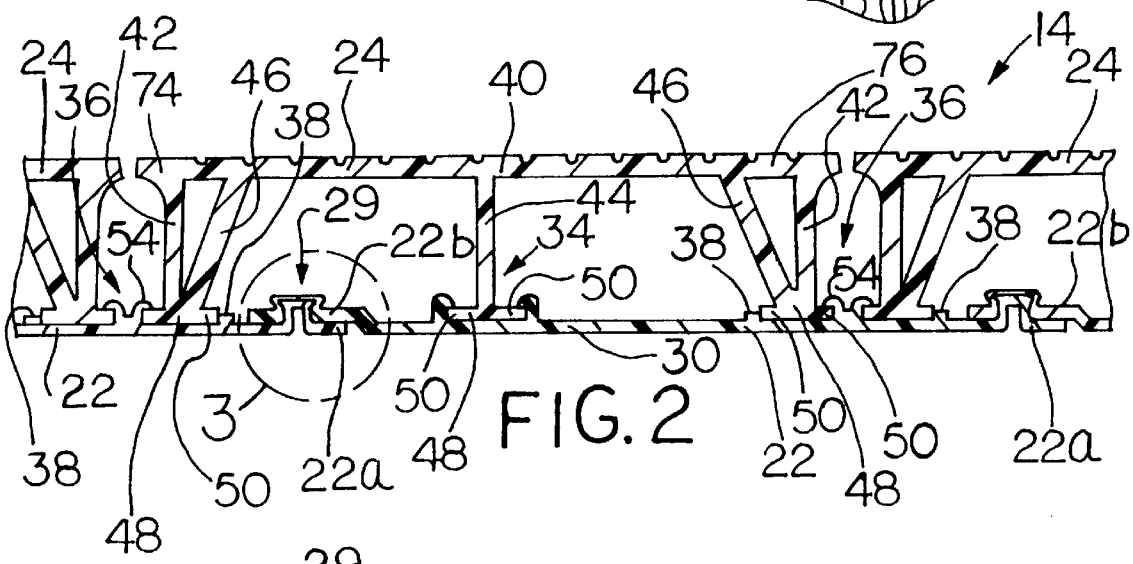
FIG. 2 is an enlarged partial cross-sectional view of the deck structure taken along line 2—2 in FIG. 1 and showing an elongated plank support strip including a plurality of clip members in engagement with one another and plank members retainably fastened to the clips.
Figures 4, 5, 6, 7, 8, 9:
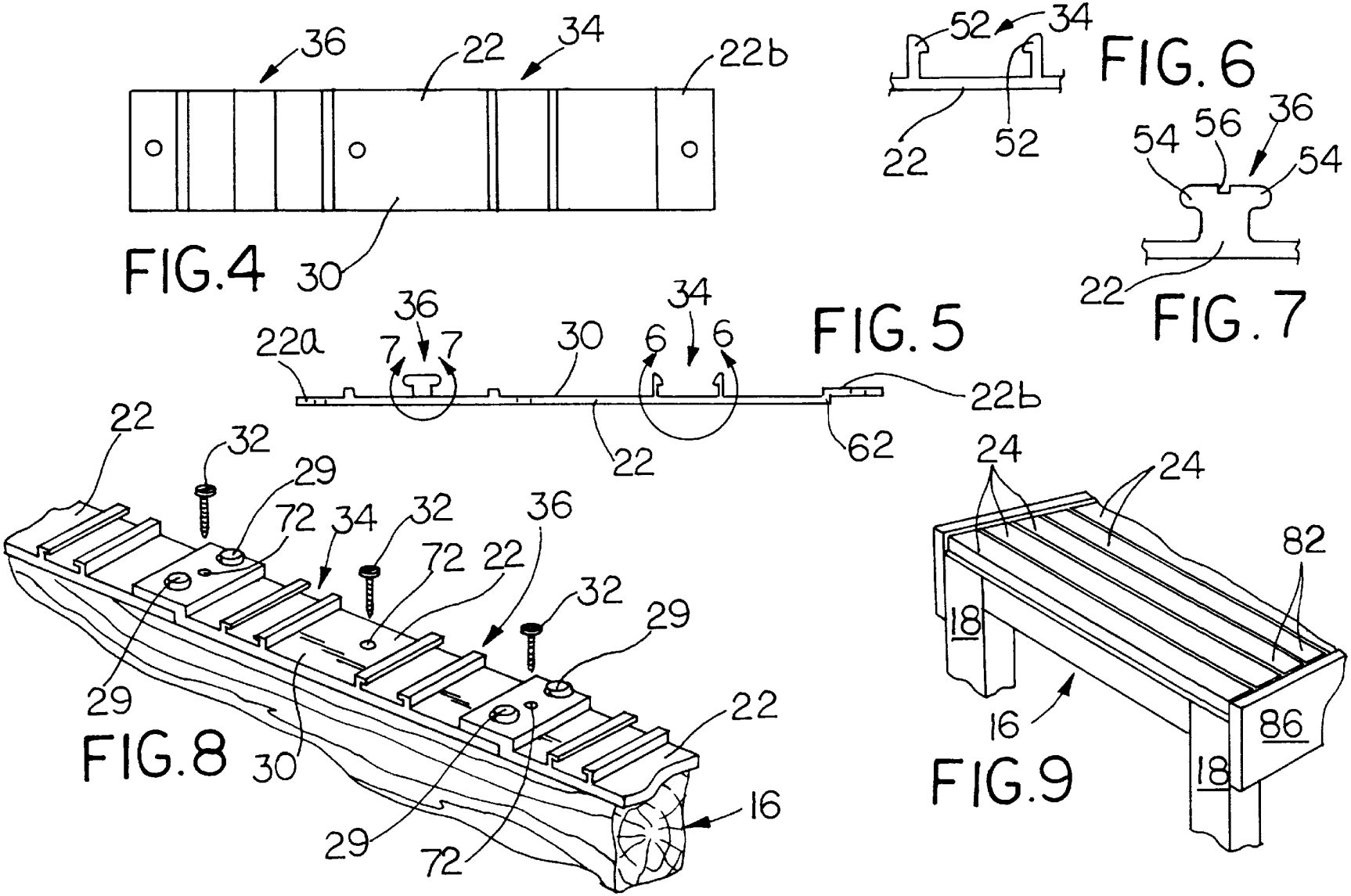
FIG. 4 is a plan view of a single clip according to the principles of the present invention.
FIG. 5 is a side view of the clip according to the principles of the present invention.
FIG. 6 is a enlarged view of section 6—6 in FIG. 5 which illustrates the plank receiving portions according to the principles of the present invention.
FIG. 7 is a enlarged side view of section 7—7 in FIG. 5 illustrating another portion of the plank receiving portion of the clip according to the principles of the present invention.
FIG. 8 is an enlarged partial perspective view of a plurality of clips positioned on the underlying support member with fastening means prepared to be inserted in order to securely affix the clips to the support member and also illustrating the TOG-L-LOC™ connection between each of the clips.
FIG. 9 is a partial perspective view of the deck structure attached to an underlying support frame in which the planks are oriented such that the ends are covered by a common end plank instead of plank caps as illustrated in FIG. 1.

FIG. 2 provides an enlarged partial cross-sectional view of the deck structure 14 taken along line 2—2 in FIG. 1 and shows a clip member 22 attached at a first end 22*a* to a second end 22*b* of a second clip member 22. According to a preferred embodiment of the present invention, the connection between the first end of a clip member and the second end 22*b* of a second clip member 22 is obtained by a TOG-L-LOC™ type joint which will be described in greater detail herein. The clip members 22 are formed with an elongate base portion 30 which is secured to the frame 16 by the fasteners 32 as shown in FIG. 8. Positioned beneath plank members 24, the fasteners 32 are concealed when used to attach the clip members 22 to the frame 16. The elongate base portion 30 is formed with a central plank receiving portion 34 and a common plank receiving portion 36 having a pair of nubs 38 disposed on opposite side thereof, the central plank receiving portion 34 and common receiving portion 36 along with nubs 38 engage and securely retain the plank members 24 with the clip members 22.

As shown in FIG. 2, the plank member 24 is formed with an upper web portion 40 to which is attached flange supporting means or supports 42. Each outward edge of the plank member 24 has a support 42 projecting downwardly from the upper web portion 40 to provide side support to the plank member 24. An intermediate flange supporting means 44 is generally midway between the support means 42 to provide central support to the plank member 24 to provide additional structural reinforcement to the upper web portion 40, a supporting brace 46 joins the upper web portion 40 at a position generally between the support means 42 and the intermediate support 44 and extends downwardly therefrom to join the support 42 in a generally diagonal fashion. On an end of the supports 42 and intermediate support 44 distal the upper web portion 40 a flange 48 is formed for cooperatively meeting with the central plank receiving portion 34, the common receiving portion 36 and nubs 38 to secure the plank member 24 in engagement with the clip member 22. The flanges 48 comprise laterally oppositely outwardly projecting members 50 formed on both sides of the supports 42 and intermediate support 44. The laterally oppositely outwardly projecting members or lateral members 50 are engagable with the central plank receiving portion 34, common receiving portion 36 and nubs 38. The central plank receiving portion 34, common receiving portion 36 and nubs 38 generally secure the flanges 48 in the same manner, however, the central plank receiving portion 34 will be described in further detail, as will the common receiving portion 36 and nubs 38.

In particular, with reference to FIG. 6, central plank receiving portion 34 is provided with opposite medial locking tabs 52 which are designed to engage the outwardly projecting members 50 of the flange 48 disposed at the end of intermediate flange support 44.

The common receiving portion 36 is provided with two oppositely projecting locking tabs 54, as shown in detail in FIG. 7. The oppositely projecting locking tabs 54 are designed to engage the flange 48 on the end supports 42 of the plank members 24. The common receiving portions 36 are provided with a central groove 56 for providing flexibility to the locking tabs 54. The nubs 38 are provided for laterally supporting the inner surface of flanges 48 disposed at the end of the supports 42.

Figure 3:
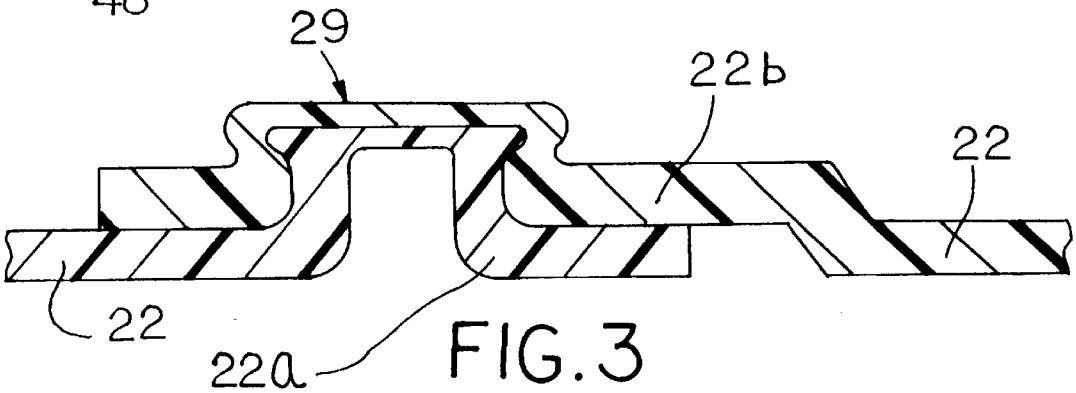
FIG. 3 is an enlarged cross-sectional view illustrating a TOG-L-LOC™ connection between the clips in order to secure the clips in engagement with one another according to a preferred embodiment of the present invention.

With reference to FIGS. 4 and 5, the second end 22*b* of elongated base portion 30 is provided with a stepped portion 62. Stepped portion 62 is offset from the plane of the elongate base portion 30 by approximately the thickness of elongate base portion 30. The step portion 62 is designed to overlap first end 22*a* of the clip members 22, as shown in FIGS. 2, 3, and 8. The clip members 22 are preferably fastened to one another by a TOG-L-LOC™ joint 29, as shown in FIG. 3. The TOG-L-LOC™ joint 29 is made by a patented fastening technique which is described in U.S. Pat. No. 5,027,503. Generally, the process involves first drawing and then laterally extruding portions of the sheet material to be joined into an enlarged shape which will permanently mechanically interlock the sheet material pieces by forming a drawn and laterally extruded joint 29. The machinery utilized for producing the drawn and extruded joint 29 is available from BTM Corporation in Marysville, Mich. As shown in FIG. 8, two TOG-L-LOC™ fastening joints 29 are provided for fastening the second end 22*b* of each clip member 22 to a first end 22*a* of a second clip member 22. It should be noted that other fastening methods can be used for fastening the clip members 22 to one another. For example, rivets, bolts, welding, glue, crimping and other techniques may be used.

The common receiving portion 36 along with nubs 38 which are provided adjacent to the second end 64 of clip members 22 provide side plank receiving means for receiving the side supports of two adjacent planks 24.

It should be noted that both the plank members, 24 and the clip members 22 are respectively unitary one piece members which are integrally formed preferably, although not necessarily through an extrusion process. The plank members and clip members may be made from plastic, aluminum, or other material. The plank member 24 in the present invention is formed of a generally rigid plastic, composite, or engineered plastic having flexibility characteristics which permit it to be assembled as will be described herein below. Such materials provide a high degree of weatherability and deterioration resistance as well as few, if any, maintenance requirements.

The clip members 22 are preferably made of extruded aluminum (6063 T-6 aluminum). It has been found that the clip members 22 may also be made of plastic, however, the combination of a plastic plank member 24 attached to a plastic clip member 22 often results in an undesirable squeaking noise. However, this noise is eliminated when a plastic plank member 24 is used with an aluminum clip member 22. It should be obvious to one skilled in the art that the plank member 24 and the clip 22, formed by an extrusion process, will have all the features illustrated in the cross section of FIG. 2 generally extending the length of the respective member. The clip member is generally a section cut from a longer extrusion whereas the plank member 24 is generally a long continual piece cut to a desired length.

Assembly of the deck structure requires the initial step of fastening the clip members 22 to one another in an end by end relationship. The TOG-L-LOC™ process is used for providing the fastening connections 29 so that the plurality of clip members 22 are integrated with one another for providing long lengths of clip members 22 which are fastened together. The clip members 22 are then fastened to the frame 16. FIG. 8 illustrates the method by which the clip members 22 are fixed to the frame 16. Generally, when fasteners 32 are used to affix the clip members 22 to the frame 16, a plurality of fastening bores 72 are formed therethrough. The clip members 22 are fastened to the frame 16 with the central plank receiving portion 34 and common receiving portion 36 in an upward orientation to which the plank member 24 may be perpendicularly attached.

With reference to FIG. 2, once the clip members 22 have been attached to the frame 16, the outwardly directed lateral members 50 of the flange 48 of a first side 74 of the plank member 24 is engaged underneath the locking tabs 54 to permit the opposing lateral member 50 of the flange 48 to be inserted into the common receiving portion 36, and the plank is generally downwardly moved to engage the medial lateral member 50 with the nub 38 to prevent horizontal motion of the flange 48 positioned in the common receiving portion 36.

The next step in attaching the plank member 24 to the clip member 22 requires that the second side 76 opposite the retained first side 74 of the plank member 24 is positioned directly above a corresponding common receiving portion 36. Attachment of the second side 76 is facilitated by the flexible characteristics of the material used in forming the plank member 24 permitting the plank 24 to be slightly flexed to permit the lateral member 48 of the second side 66 to be angularly inserted underneath the locking tab 54 of the common receiving portion 36. When engaging the second side 76, once the lateral member 50 is positioned under the locking tab 54, a slight downward force supplied to the top surface of the upper web portion 40 above the support 42 of the second side 76 may be required to force the medial lateral member 50 in position against the nub 38.

Once the plank member 24 has a first side 74 and a second side 76 retained within corresponding common receiving portions 36, the flange 48 of the intermediate support 44 is positioned on top of the locking tabs 52 of the central plank receiving portion 34, depending upon the flexibility characteristic of the material used in forming the clip member 22, the force created by the slightly upwardly flexed upper web portion 40 may force the flange 48 into engagement with the central plank receiving portion 34. However, if the material used in the clip member 22 is rigid enough to withstand the downward force created by the upwardly flexed upper web portion 38, a slight downward force applied to the top surface of the upper web portion 40 generally in the area directly above the intermediate support 44 may be necessary to force the flange 48 into engagement with the central plank receiving portion 34.

As an alternative method of mounting the plank members 24 to the clip members 22, the plank members 24 can be positioned relative to the clip to slide the plank 24 into engagement with the clip members 22. Using this method of attachment, downward compressive forces on the plank member are not necessary since the plank 24 can be easily slid into engagement with the clip members 22. It should be obvious to one skilled in the art that either method can be used to secure the plank 24 to the clip member 22 and that one method may be preferred over another depending upon circumstances of installation.

FIG. 9 provides a partial perspective view of a deck structure 14 attached to an underlying support frame in which the ends 82 of the planks 24 have been covered by a common plank 86 attached to the support structure 16 generally perpendicular to the direction of the attached planks 24. This common plank 86 obviates the need for individual plank caps 28 (as illustrated in FIG. 1) and provides a means for preventing the planks from being slid out of engagement with the clip members 22.

With reference to FIGS. 10 and 11, a second embodiment of the present invention will be described. In FIG. 10, the clip members 90 are provided with a central plank receiving portion 92 and a common receiving portion 94. Each of the clip members 90 has an elongates base portion 96 having first and second ends 98, 100. The first end 98 of the elongate base portion 96 is provided with locking tabs 102 while the second end 100 is provided with a stepped portion 104 having recessed tab mating portions 106. The stepped portion 104 of second end 100 is designed to overlap first end 98 so that locking tabs 102 engage recessed tab receiving portions 106 in order to fasten the clip members 90 together. The central plank receiving portion 92 and the common plank receiving portions are substantially the same as the plank receiving portions shown in the first embodiment of the present invention. Therefore, a detailed explanation of the manner of fastening the plank members 24 to the clip members 90 has been omitted.

With reference to FIGS. 12 and 13, a third embodiment of the present invention will now be described. As shown in FIG. 12, the clip members 110 are provided for interlocking engagement with one another. The clip members 110 have an elongated base 112 having a first end 114 and a second end 116. The first end 114 is provided with a semicircular flange portion 118 which is designed to be interconnected with a semicircular recessed portion 120 disposed in the second end 116 of the elongate base 112. The semicircular flange portion 118 and semicircular recess portion 120 allow the clip members 110 to be locked into engagement with one another. The elongate base portion 112 includes a central plank receiving portion 122 and a common plank receiving portion 124 which are arranged similarly to the plank receiving portions of the second embodiment described in FIGS. 10 and 11. Furthermore, the process for connecting the plank members 24 to the clip members 110 is substantially the same as described for the first embodiment of the present invention. Therefore, a description of the connecting process has been omitted.

With reference to FIGS. 14 and 15, a fourth embodiment of the present invention will now be described. In FIG. 14, the clip member 130 is provided with an elongate base 132. The elongate base 132 has a first end 134 and a second end 136. The first end 134 is provided with a protruding flange 138 which is designed to be engaged with a corresponding opening 140 in second end 136 of the elongate base 132. Elongate base 132 is also provided with a central plank receiving portion 142 and first and second side plank receiving portions 144, 146, one each provided at the first and second ends 134, 136 of clip member 130. The extending flange portion 138 and flange receiving portion 140 allow the clip members 130 to be fastened to one another.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A deck structure comprising:

a plurality of planks; and a plurality of clip member each having a first and a second end, an end of one clip member fastened to an end of another clip member, and at least one clip member having a plank receiving portion being operable to secure at least one of the planks to at least one of the clip members.

2. The deck structure as set forth in claim 1, further comprising means for securing the first end of one of the plurality of clip members to the second end of another of the plurality of clip members.

3. The deck structure as set forth in claim 1, wherein at least one of the planks includes a web portion and a plurality of flange supporting members extending from the web portion.

4. The deck structure as set forth in claim 1, wherein the first end of at least one of the plurality of clip members is provided with a stepped portion.

5. The deck structure as set forth in claim 3, wherein the plank receiving portions further have a second flange engaging portion.

6. The deck structure as set forth in claim 5, wherein the second flange engaging portion includes at least one nub.

7. The deck structure as set forth in claim 6, wherein the second flange engaging portion includes a locking member.

8. The deck structure as set forth in claim 7, wherein the second flange engaging portion includes at least two nubs and the locking member is located between the two nubs.

9. The deck structure as set forth in claim 7, wherein the locking member includes a locking tab.

10. The deck structure as set forth in claim 3, wherein each of the flange supporting members includes a flange.

11. The deck structure as set forth in claim 3, wherein each of the plank receiving portions has a first flange engaging portion.

12. The deck structure as set forth in claim 11, wherein each of the first flange engaging portions includes at least one locking tab.

13. The deck structure as set forth in claim 12, wherein the locking tabs are cantilevered over the base portion.

14. The deck structure as set forth in claim 11, wherein each of the first flange engaging portions includes at least two locking tabs extending toward one another.

15. A deck structure comprising a plurality of clip members each having a base portion having an intermediate flange receiving portion including two locking tabs projecting toward one another and a common flange receiving portion having two nubs and a locking member intermediate the two nubs, the locking member having a locking tab provided on opposite sides thereof, the base portion having a first end fastened to an end of another clip member; and a plurality of plank members having at least one flange supporting portion with a flange attached thereto.

16. The deck structure according to claim 15, wherein the first end of the base is provided with a stepped portion which is adapted to be overlapped with and fastened to a second end of another clip member.

17. The deck structures according to claim 15, wherein one end of the base is provided with a pair of locking tabs.

18. The deck structure according to claim 15, wherein one end of the base is provided with a locking flange portion.

19. The deck structure according to claim 15, wherein one end of the base is provided with a stepped portion.

20. The deck structure according to claim 19, wherein the stepped portion includes a recessed area.

21. The deck structure according to claim 18, wherein one end of the base is provided with a recessed locking portion.

22. A deck structure comprising:

a plurality of planks;

a supporting frame operable to support said plurality of planks;

a first elongated plank support strip operable to secure said plurality of planks to said supporting frame, said first elongated plank support strip including:

(a) a first plurality of clip members each operable to support a portion of one of said plurality of planks, and (b) each of said first plurality of clip members interengaging at least one other of said first plurality of clip members so as to form said first elongated plank support strip;

a second elongated plank support strip operable to secure said plurality of planks to said supporting frame, said second elongated plank support strip including:

(a) a second plurality of clip members each operable to support a portion of one of said plurality of planks, (b) each of said second plurality of clip members interengaging at least one other of said second plurality of clip members so as to form said second elongated plank support strip;

whereby said first and second elongated support strips are operable to secure said plurality of planks to said supporting frame.

23. The deck structure as set forth in claim 22, wherein at least one of said clip members includes at least one nub; and a locking member having a locking tab disposed thereon.

24. The deck structure as set forth in claim 22, wherein each of said clip members has a first end and a second end, said first end being provided with a stepped portion.

25. The deck structure as set forth in claim 22, wherein each of said first plurality of clip members are attached to another clip member by a drawn and laterally extruded joint.

26. A method of assembling a deck structure comprising the steps of:

providing a plurality of clip members;

interengaging the plurality of clip members so as to form at least one plank support strip;

securing the plank support strip to a supporting frame; and securing the plurality of planks to the plank support strip.

27. The method of assembling a deck structure according to claim 26, further comprising the steps of forming a stepped portion on an end of each of the clip members; and securing the end with the stepped portion to an end of another clip member.

28. The method of assembling a deck structure as set forth in claim 27, wherein the step of securing the end of the clip member having a stepped portion to an end of another clip member includes the step of drawing and extruding the end of one clip member with the end of an adjacent clip member.

* * * * *